US007064636B1

(12) United States Patent
Walz et al.

(10) Patent No.: US 7,064,636 B1
(45) Date of Patent: Jun. 20, 2006

(54) SHAPE MEMORY ALLOY TRIP MECHANISM FOR ARC/GROUND FAULT CIRCUIT INTERRUPTION

(75) Inventors: Michael F. Walz, Mays Landing, NJ (US); Patrick W. Mills, Bradenton, FL (US); Richard G. Benshoff, Sarasota, FL (US); Peter L. Nerstrom, Sarasota, FL (US)

(73) Assignee: Eaton Corporation, Cleveland, OH (US)

( * ) Notice: Subject to any disclaimer, the term of this patent is extended or adjusted under 35 U.S.C. 154(b) by 1 day.

(21) Appl. No.: 11/016,950

(22) Filed: Dec. 20, 2004

(51) Int. Cl.
*H01H 83/06* (2006.01)

(52) U.S. Cl. ..... 335/18; 337/75

(58) Field of Classification Search ..... 335/18; 361/42; 337/70, 75
See application file for complete search history.

(56) References Cited

U.S. PATENT DOCUMENTS

| | | | |
|---|---|---|---|
| 4,570,143 | A | 2/1986 | Bridges et al. |
| 4,570,144 | A | 2/1986 | Bridges et al. |
| 4,616,206 | A | 10/1986 | Bridges et al. |
| 4,713,643 | A | 12/1987 | Baum et al. |
| 5,420,561 | A | 5/1995 | Swenson |
| 2002/0149463 | A1 | 10/2002 | Kautz et al. |
| 2004/0085167 | A1* | 5/2004 | McCormick et al. ..... 335/16 |

* cited by examiner

*Primary Examiner*—Lincoln Donovan
(74) *Attorney, Agent, or Firm*—Marvin L. Union

(57) ABSTRACT

A miniature circuit breaker comprising a non-conductive housing assembly; a pair of separable contacts including a first, fixed contact coupled to said housing assembly and having a terminal extending outside said housing assembly, and a second, movable contact having a terminal extending outside said housing assembly; an operating mechanism coupled to, and structured to move, said movable contact between a first position, wherein said movable contact engages said fixed contact, and a second position, wherein said movable contact is spaced from said fixed contact; a trip device coupled to said operating mechanism and structured to actuate said operating mechanism to separate said separable contacts upon the occurrence of a trip condition; an arc fault trip mechanism having an arc fault detector and a shape memory alloy element; said arc fault detector structured to detect an arc fault on the load side of said separable contacts and to provide an electrical pulse; said shape memory alloy element structured to transform between a first shape and a second shape during the application of an electrical pulse, said shape memory alloy element having a first end and a second end, said shape memory alloy element first end coupled to said housing assembly, said shape memory alloy element coupled to said trip device; said arc fault detector further coupled to said shape memory alloy element and structured to provide an electrical pulse to said shape memory alloy element sufficient to transform said shape memory alloy element from said first shape and said second shape; and wherein when said shape memory alloy element is in said second shape, said trip device is actuated and said operating mechanism separates said separable contacts.

11 Claims, 3 Drawing Sheets

SHAPE MEMORY ALLOY TRIP MECHANISM FOR ARC/GROUND FAULT CIRCUIT INTERRUPTION

GOVERNMENT CONTRACT

The Government of the United States of America has certain rights in this invention pursuant to Office Naval Research Contract No. N00014-02-C-0509.

BACKGROUND OF THE INVENTION

1. Field of the Invention

The present invention relates to a miniature circuit breaker and, more specifically, to a miniature circuit breaker having an arc fault detector structured to actuate a shape memory alloy element coupled to a trip device.

2. Background Information

Miniature circuit breakers are used in devices with limited space and/or weight limitations, such as, but not limited to, aircraft. A miniature circuit breaker has the typical circuit breaker components, such as a non-conductive housing, an external actuator, at least two external terminals structured to be coupled to a line and a load, a pair of separable contacts including a first, stationary contact electrically coupled to one external terminal and a second, movable contact couple to the other external contact, an operating mechanism structured to move the separable contacts between a first, closed position wherein the contacts engage each other and a second position, wherein the contacts are separated, and a trip device structured to latch the operating mechanism in the first position until an over-current condition occurs. The operating mechanism has a spring biasing the separable contacts to the second position. Thus, when the trip device is actuated, the latch releases the operating mechanism and the separable contacts move to the second position. The operating mechanism is further coupled to the external actuator. The external actuator is structured to move the separable contacts to the first position after a trip event, or may be used to manually separate the contacts.

In the prior art, a circuit breaker having arc fault protection included a trip device with at least two tripping mechanisms; one mechanism for an over-current situation and one mechanism for an arc fault on the load side of the circuit breaker. The over-current mechanism typically included an elongated bimetal element that would bend in response to temperature changes. The act of bending actuated the latch thereby allowing the operating mechanism to separate the separable contacts. Heat is created in response to current passing through the bimetal element. Thus, the greater the amount of current, the greater the degree of bending. The electronic arc fault mechanism included an electronic arc fault detector and a solenoid assembly. When the electronic arc fault detector sensed an arc, a pulse was sent to the solenoid and the solenoid actuated the trip device. The disadvantage to the electronic arc fault mechanism is that the solenoid is a relatively large mechanism that requires additional space.

There is, therefore, a need for a smaller mechanism structured to activate the trip device in the event of an arc fault.

There is a further need for a miniature circuit breaker able to detect and trip in the event of an arc fault.

SUMMARY OF THE INVENTION

These needs, and others, are met by the present invention which provides a miniature circuit breaker having an arc fault trip mechanism that includes an arc fault detector and a shape memory alloy element. The arc fault detector is structured to detect an arc fault on the load side of the circuit breaker and, in the event of an arc, to provide an electrical pulse. The shape memory alloy element is structured to transform between a first shape and a second shape upon the application of an electrical pulse. More specifically, the shape memory alloy element is structured to transform between a first, longer length and a second, shorter length. The shape memory alloy element is coupled to the trip device latch which, in a first position, is structured to hold the operating mechanism in a first position wherein the circuit breaker separable contacts are closed. When the shape memory alloy element is in the first shape, the latch may be maintained in the first position. When the shape memory alloy element is transformed into the second shape, the shape memory alloy element acts to disengage the latch, that is move the latch into a second position where the latch no longer holds the operating mechanism in the first position. Accordingly, once the operating mechanism is free from restraint, the operating mechanism moves to the second, open position thereby opening the separable contacts. The shape memory alloy element is substantially smaller than a solenoid structured to perform the same function.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As used herein, directional terms, such as, but not limited to, "upper" and "lower" relate to the components as shown in the Figures and are not limiting upon the claims.

Figure 2:
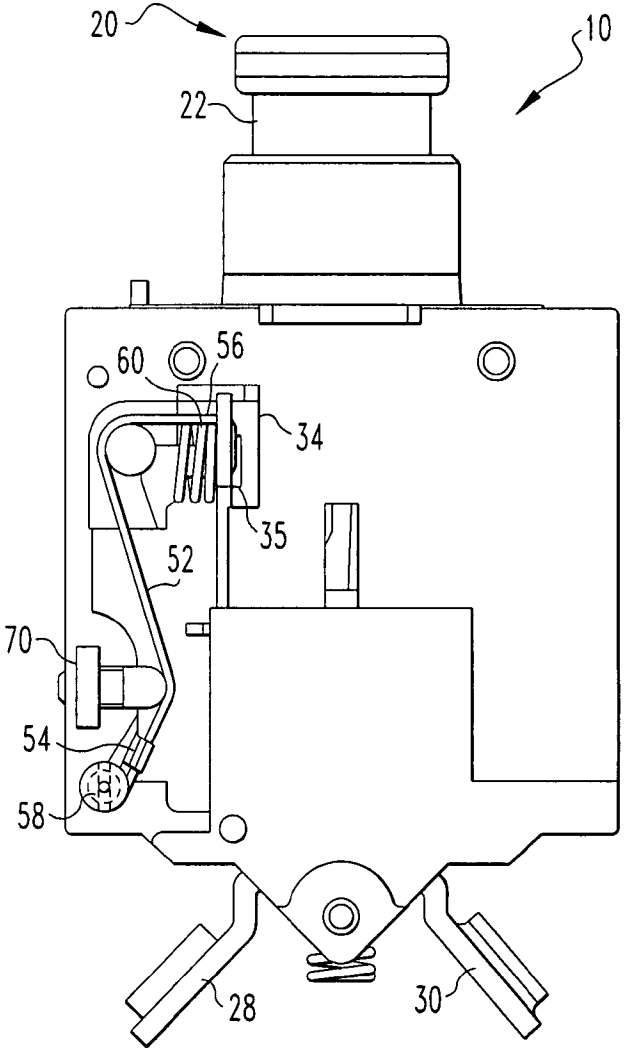
FIG. 2 is a back side view of a circuit breaker with the separable contacts in the first position.
Figure 1:
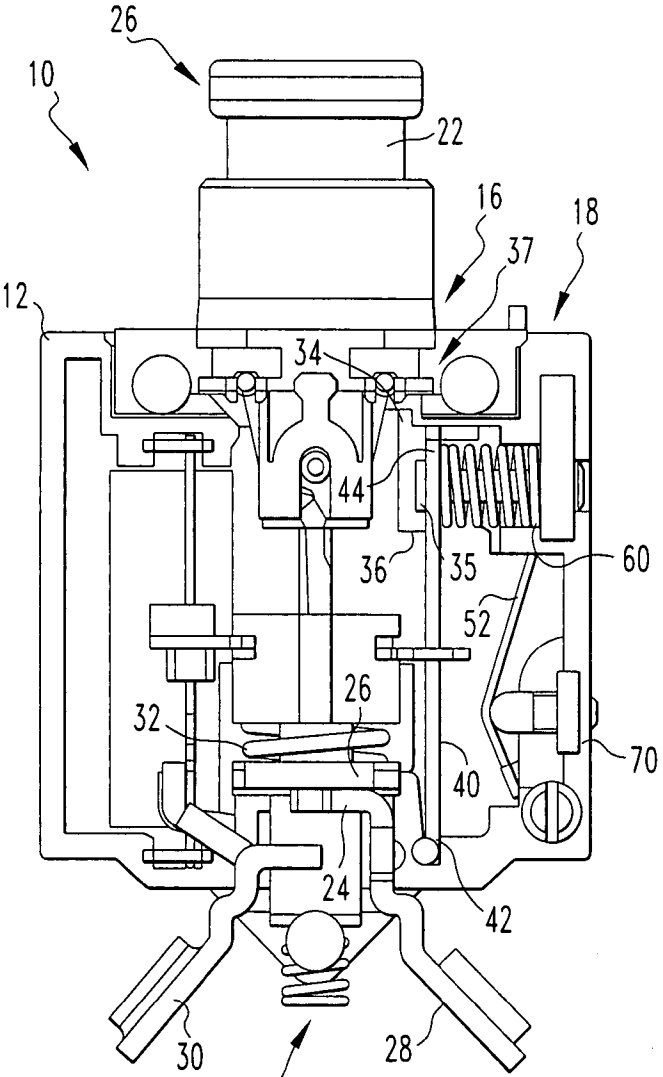
FIG. 1 is a front side view of a circuit breaker with the separable contacts in the first position.
Figure 4:
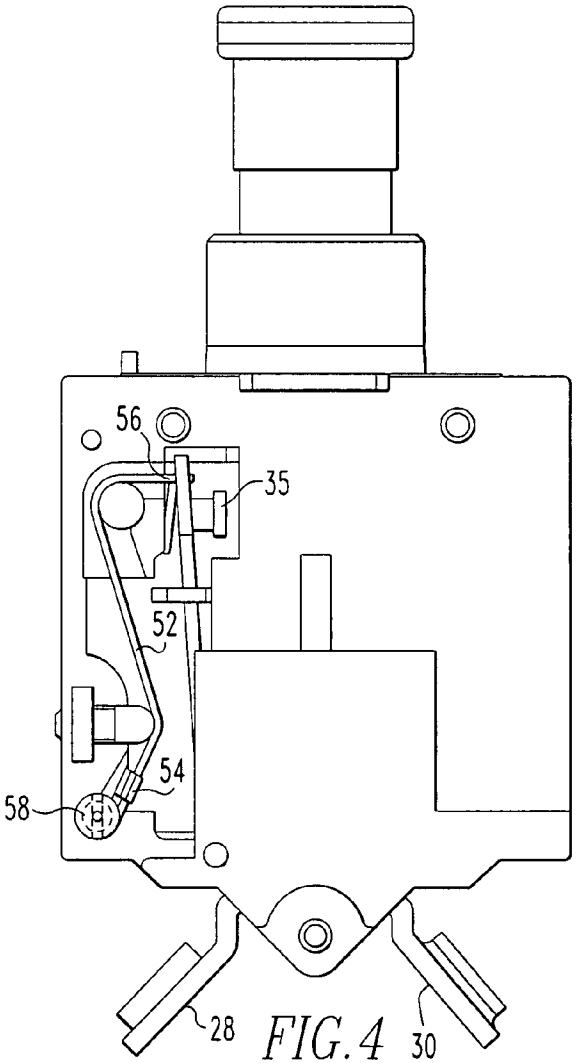
FIG. 4 is a back side view of a circuit breaker with the separable contacts in the second position.

As shown in FIG. 1, a miniature circuit breaker 10 includes a non-conductive housing assembly 12, a pair of separable contacts 14, an operating mechanism 16, and a trip device 18. The housing assembly 12 includes an actuator device 20 in the form of a button 22 structured to travel in the vertical direction. The button 22 is enclosed in a bushing 23. The bushing 23 contacts the aircraft panel (not shown) and acts as a ground. The pair of separable contacts 14 includes a first, fixed contact 24 coupled to the housing assembly 12 and a second, movable contact 26. Both the first and second contact 24, 26 each are coupled to, or are integral with, a terminal 28, 30, respectively, that extends outside said housing assembly 12. The external terminals 28, 30 are structured to be coupled to either a line or a load (not shown).

Figure 3:
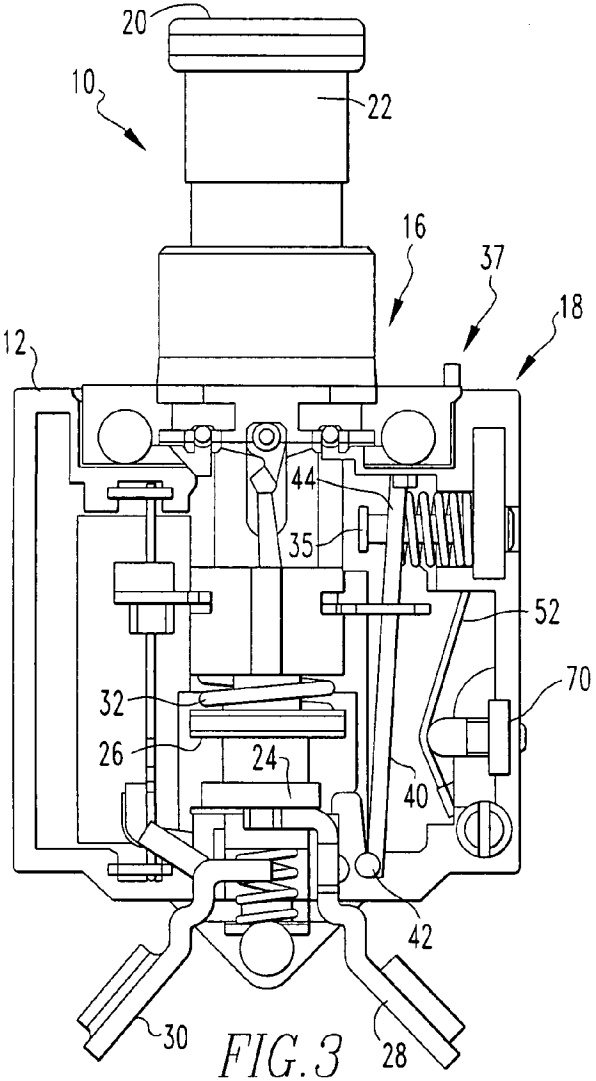
FIG. 3 is a front side view of a circuit breaker with the separable contacts in the second position.

The operating mechanism 16 is coupled to, and structured to move, the separable contacts 14 between a first, closed position (FIG. 1), wherein the movable contact 26 engages the fixed contact 24, and a second, open position (FIG. 3), wherein the movable contact 26 is spaced from the fixed contact 24. The operating mechanism 16 includes a spring 32 that is structured to bias the separable contacts 14 to the second, open position.

The trip device 18 includes a latch assembly 34, an ambient compensator 37, and an arc fault trip mechanism 38. The latch assembly 34 includes a latch member 35 and a catch member 36. The catch member 36 is coupled to the operating mechanism 16. The latch member 35 is structured to move between a first, latched position wherein the operating mechanism 16 is held, via the catch member 36, in the operating mechanism 16 first position, and, a second, open position wherein the operating mechanism 16 is not restrained. Thus, when the latch member 35 is in the latch member 35 second position, the operating mechanism 16 is free to move, due to the bias of the spring 32, to the operating mechanism 16 second position. The latch member 35 is reset, that is, reengages the catch member 36, when a user depresses the housing actuator device 20.

The ambient compensator 37 includes an elongated bimetal element 40. The bimetal element 40 has a first end 42 and a second end 44. The bimetal element first end 42 is pivotally coupled to the housing assembly 12. Thus, the bimetal element 40 is able to rotate about the bimetal element first end 42 between a first position and a second position, as discussed in further detail below. The bimetal element 40 is, as known in the art, also structured to bend between a first configuration, wherein the bimetal element 40 is generally linear, and a second configuration, wherein the bimetal element 40 is arced. The bimetal element 40 bends in response to heat that builds up as a result of current flowing therethrough. Generally, the greater the current, the greater the heat generated, and the greater the degree of bending. The bimetal element 40 is disposed in the current path between the first, fixed contact 24 and the second, movable contact 26. As such, when the separable contacts 14 are in the first, closed position, electricity flows through the bimetal element 40. The latch member 35 is disposed at the bimetal element second end 44. In operation, when an over-current condition occurs, the bimetal element 40 bends to a sufficient degree to move the latch member 35 into the latch member 35 second position. Thus, in response to an over-current condition, the bimetal element 40 trips the circuit breaker 10. In order to close the separable contacts 14 and maintain the separable contacts 14 in the first position, the bimetal element 40 must return to the first configuration and a user must reset the latch assembly 34 by depressing the housing actuator device 20.

Figure 5:
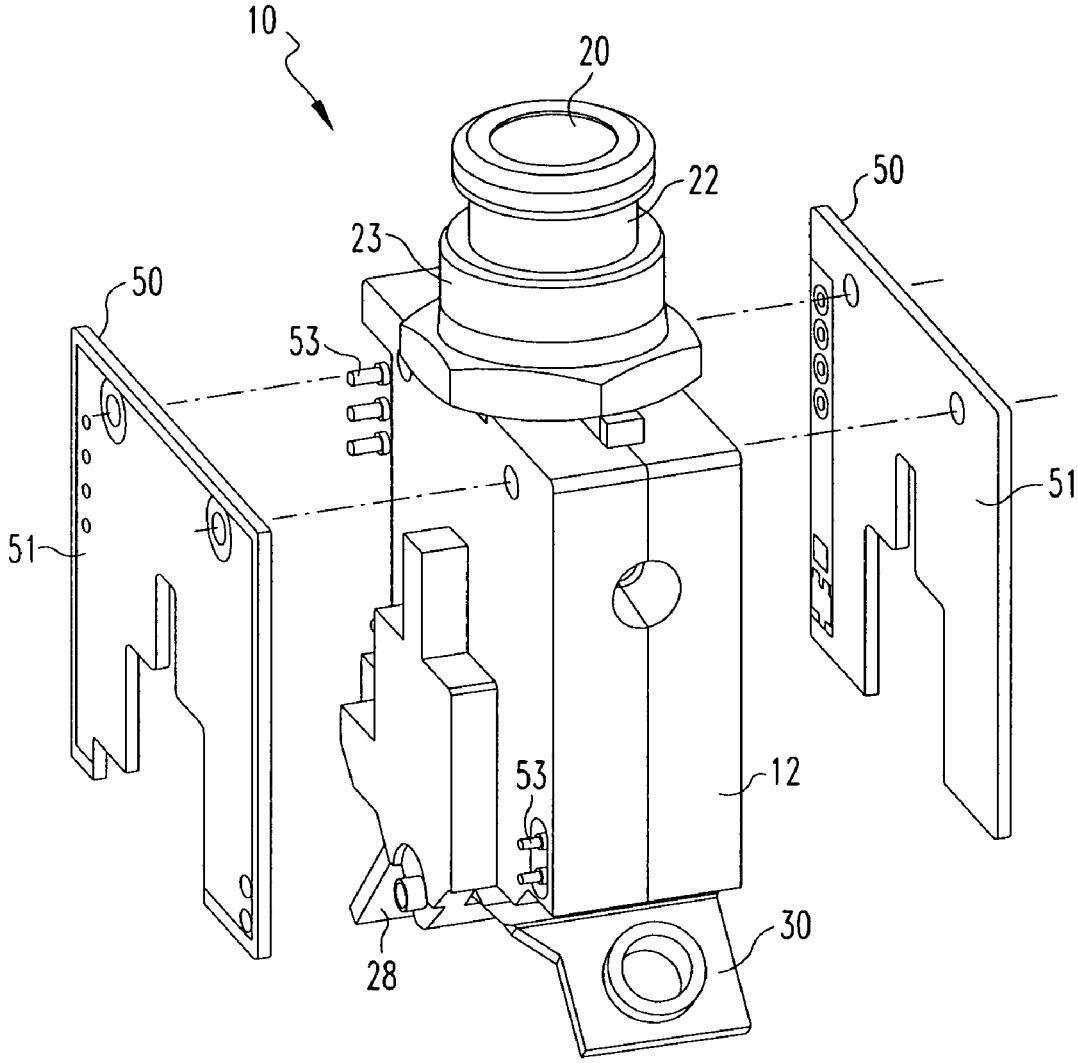
FIG. 5 is an isometric view of the circuit breaker showing the arc fault detector.

As shown in FIG. 5, the arc fault trip mechanism 38 includes at least one, and preferably two, arc fault detector(s) 50 and a shape memory alloy element 52. The arc fault detector is a printed circuit board 51 that is in electrical communication with the line terminal 28 and the bushing 23 via selected terminals 53 and mounting rivets 55. The arc fault detector 50 is structured to detect an arc fault on the load side of the separable contacts 14. The arc fault detector 50 is further structured to provide an electrical pulse to the conductor 58. The response time and duration of the arc fault detector 50 electrical pulse is less than about 20 milliseconds. The shape memory alloy element 52 has a first end 54 and a second end 56. The first end 54 is coupled to the housing assembly 12 and to the conductor 58. The shape memory alloy element second end 56 is also in electrical communication, via the spring 60, rivet 55 and the printed circuit board 51, to the bushing 23. The shape memory alloy element second end 56 is coupled to the latch member 35. Preferably, the shape memory alloy element 52 is coupled to the latch member 35 via the bimetal element 40. The shape memory alloy element 52 is structured to transform between a first shape and a second shape during the application of an electrical pulse. When no pulse is applied, the shape memory alloy element 52 returns to the first shape. In a preferred embodiment, the shape memory alloy element 52 first shape has a length of between about 1.1 and 0.9 inch, and more preferably about 1.0 inch. Further, the shape memory alloy element 52 second shape has a length of between about 1.056 and 0.864 inch, and more preferably about 0.96 inch. That is, in one embodiment, upon and during the application of an electrical pulse the shape memory alloy element 52 shrinks. The transformation between the first and second shape occurs in less than about 20 milliseconds. The arc fault detector 50 is coupled to the shape memory alloy element 52 and is structured to provide an electrical pulse to the shape memory alloy element 52 sufficient to transform the shape memory alloy element 52 from the first shape to the second shape. In this configuration, when the shape memory alloy element 52 transforms into the second shape, the shape memory alloy element 52 acts upon the bimetal element 40 causing the bimetal element 40 to pivot about the bimetal element first end 42. The act of pivoting the bimetal element 40 about the bimetal element first end 42 moves the latch member 35 into the latch member second position, thereby tripping the circuit breaker 10 as described above. In order to close the separable contacts 14 and maintain the separable contacts 14 in the first position, the shape memory alloy element 52 must be returned to the first shape and a user must reset the latch assembly 34 by depressing the housing actuator device 20.

The arc fault trip mechanism 38 may further include a return spring 60. The return spring 60 is coupled to the housing assembly 12 and biases the bimetal element 40 into the first position. Thus, after the arc fault detector 50 pulse is turned off, the shape memory alloy element 52 returns to the first shape and the return spring 60 biases the bimetal element 40 into the first position, wherein the latch assembly 34 may be reset. The arc fault trip mechanism 38 may further include a shape memory alloy element adjustment device 70. The shape memory alloy element adjustment device 70 acts as a barrier that the shape memory alloy element 52 must travel over. The shape memory alloy element adjustment device 70 is structured to move into, or out from, the path of the shape memory alloy element 52. It is noted that the circuit breaker 10 may be tripped, that is have the latch member 35 moved into the second position by having either the bimetal element 40 bent into the second configuration and/or by having the bimetal element 40 moved into the second position by the shape memory alloy element 52. In order for the latch member 35 to be moved into the first position, the bimetal element 40 must be in both the first position and the first configuration.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A miniature circuit breaker comprising:

a non-conductive housing assembly;

a pair of separable contacts including a first, fixed contact coupled to said housing assembly and having a terminal extending outside said housing assembly, and a second, movable contact having a terminal extending outside said housing assembly;

an operating mechanism coupled to, and structured to move, said movable contact between a fist position, wherein said movable contact engages said fixed contact, and a second position, wherein said movable contact is spaced from said fixed contact;

a trip device coupled to said operating mechanism and structured to actuate said operating mechanism to separate said separable contacts upon the occurrence of a trip condition;

an arc fault trip mechanism having an arc fault detector and a shape memory alloy element;

said arc fault detector structured to detect an arc fault on the load side of said separable contacts and to provide an electrical pulse;

said shape memory alloy element structured to transform between a first shape and a second shape during the application of an electrical pulse, said shape memory alloy element having a first end and a second end, said shape memory alloy element first end coupled to said housing assembly, said shape memory alloy element coupled to said trip device;

said arc fault detector further coupled to said shape memory alloy element and structured to provide an electrical pulse to said shape memory alloy element sufficient to transform said shape memory alloy element from said first shape and said second shape; and wherein when said shape memory alloy element is in said second shape, said trip device is actuated and said operating mechanism separates said separable contacts.

2. The miniature circuit breaker of claim 1 wherein:

said arc fault detector is structured to apply said electrical pulse for less than about 20 milliseconds; and said shape memory alloy element transforms between said first shape and said second shape in less than about 20 milliseconds.

3. The miniature circuit breaker of claim 1 wherein said shape memory alloy element in said first shape has a first length and said shape memory alloy element in said second shape has a second length.

4. The miniature circuit breaker of claim 3 wherein:

said first length is between about 1.1 and 0.9 in.; and said second length is between about 1.056 and 0.864 in.

5. The miniature circuit breaker of claim 3 wherein:

said first length is about 1.0 in.; and said second length is about 0.96 in.

6. The miniature circuit breaker of claim 1 wherein:

said operating mechanism includes a spring structured to bias said operating mechanism in said second position;

said trip device includes a latch member, said latch member structured to move between a first, latched position wherein said operating mechanism is held in said first position and second, open position wherein said operating mechanism is not restrained; and wherein said shape memory alloy element is coupled to said latch member so that when said shape memory alloy element is in said first shape, said latch member is in said first position and when said shape memory alloy element is in said second shape, said latch member may be moved into said second position.

7. The miniature circuit breaker of claim 6 wherein:

said trip device includes an ambient compensator, said ambient compensator including an elongated bimetal element having a first end and a second end, said bimetal element first end pivotally coupled to said housing assembly, said bimetal element structured to bend between a first configuration, wherein said bimetal element is generally linear, and a second configuration, wherein said bimetal element is arced, said bimetal element further structured to rotate about said bimetal element first end between a first position and a second position;

said bimetal element second end structured to engage said latch member and position said latch member in said first position when said bimetal element is in said first configuration and further structured to move said latch member into said latch member second position when said bimetal element bends into said second configuration;

said bimetal element further structured to position said latch member in said first position when said bimetal element is in said first configuration and said first position, and further structured to move said latch member into said latch member second position when said bimetal element is in said first configuration and said bimetal element moves to said second position;

said trip device further including a return spring coupled to said housing assembly and structured to bias said bimetal element into engagement with said latch member when said shape memory alloy element is in said first shape and said bimetal element is in said first configuration;

said shape memory alloy element coupled to said bimetal element second end;

said shape memory alloy element structured to overcome the bias of said return spring and move said bimetal element into said bimetal element second position when said shape memory alloy element transforms into said second shape; and wherein said shape memory alloy element does not overcome the bias of said return spring when said shape memory alloy element is in said first shape, thereby allowing said return spring to position said bimetal element in said bimetal element in said first position when said bimetal element is in said first configuration.

8. The miniature circuit breaker of claim 7 wherein:

said arc fault detector is structured to apply said electrical pulse for less than about 20 milliseconds; and said shape memory alloy element transforms between said first shape and said second shape in less than about 20 milliseconds.

9. The miniature circuit breaker of claim 7 wherein said shape memory alloy element in said first shape has a first length and said shape memory alloy element in said second shape has a second length.

10. The miniature circuit breaker of claim 9 wherein:

said first length is between about 1.1 and 0.9 in.; and said second length is between about 1.056 and 0.864 in.

11. The miniature circuit breaker of claim 9 wherein:

said first length is about 1.0 in.; and said second length is about 0.96 in.

* * * * *